US006979151B1

(12) United States Patent
Bourgeo

(10) Patent No.: US 6,979,151 B1
(45) Date of Patent: Dec. 27, 2005

(54) TIMBER PILE CONNECTOR

(76) Inventor: Henry Bourgeo, 5505 Lhret Rd., Marrero, LA (US) 70072

( * ) Notice: Subject to any disclaimer, the term of this patent is extended or adjusted under 35 U.S.C. 154(b) by 47 days.

(21) Appl. No.: 10/714,746

(22) Filed: Nov. 17, 2003

(51) Int. Cl.[7] ..... E02D 5/16; F16B 12/36

(52) U.S. Cl. ..... 405/251; 405/252; 405/257; 403/292; 403/305

(58) Field of Search ..... 405/250–252, 405/229, 256, 257, 292, 268; 403/305, 306, 292, 268; 52/170, 726; 411/503, 447

(56) References Cited

U.S. PATENT DOCUMENTS

| | | | | | |
|---|---|---|---|---|---|
| 265,141 | A | | 9/1882 | Putnam | |
| 653,017 | A | | 7/1900 | Waal | |
| 684,044 | A | | 10/1901 | Commons | |
| 1,073,614 | A | * | 9/1913 | McDearmid | 405/251 |
| 1,079,375 | A | | 11/1913 | Stange | |
| 1,929,280 | A | | 10/1933 | King | |
| 2,222,481 | A | * | 11/1940 | Ferguson et al. | 405/250 |
| 2,333,930 | A | * | 11/1943 | Hedstrom | 411/503 |
| 3,065,009 | A | * | 11/1962 | Austin | 403/341 |
| 3,201,834 | A | * | 8/1965 | Baittinger | 403/312 |
| 3,307,362 | A | | 3/1967 | Cravens et al. | |
| 3,720,068 | A | | 3/1973 | Rosa | |
| 3,802,206 | A | | 4/1974 | Moore et al. | |
| 3,924,413 | A | | 12/1975 | Marsh, Jr. | |
| 4,032,244 | A | | 6/1977 | Quayle | |
| 4,407,601 | A | * | 10/1983 | Reeder | 403/25 |
| 4,431,347 | A | | 2/1984 | Gillen, Jr. | |
| 4,525,102 | A | | 6/1985 | Gillen | |
| 4,537,534 | A | * | 8/1985 | Marsh, Jr. | 405/252 |
| 4,696,605 | A | | 9/1987 | Gillen, Jr. | |
| 5,593,251 | A | | 1/1997 | Gillen | |
| 6,183,167 | B1 | * | 2/2001 | Ruiz et al. | 405/251 |
| 6,494,644 | B1 | * | 12/2002 | Scandaliato et al. | 405/251 |
| H2080 | H | | 9/2003 | Bourgeois | |
| 6,612,772 | B1 | * | 9/2003 | DeMarco et al. | 403/256 |
| 6,688,145 | B2 | * | 2/2004 | Tan | 70/58 |
| 2003/0177626 | A1 | * | 9/2003 | Paynter | 29/417 |

* cited by examiner

*Primary Examiner*—Jong-Suk (James) Lee
(74) *Attorney, Agent, or Firm*—Wyatt, Tarrant & Combs, LLP

(57) ABSTRACT

A timber pile connector for splicing timber pilings together comprising a section of pipe having a continuous sidewall and a hollow bore, a pair of opposing slots through the sidewall, and a bar passing through the slots. A first end of the bar has a first cut therein to thereby form a first upper retaining member and a first lower retaining member. A second end of the bar has a second cut therein to thereby form a second upper retaining member and a second lower retaining member. The first and the second upper retaining members are bent upward against an outer surface of the side wall of the section of pipe, while the first and the second lower retaining members bent downward against the outer surface of the sidewall, such that the retaining members fixedly secure the bar in the slots to thereby form a penetration barrier in the section of pipe.

16 Claims, 5 Drawing Sheets

TIMBER PILE CONNECTOR

CROSS REFERENCE TO RELATED APPLICATIONS

Not applicable

STATEMENT REGARDING FEDERALLY SPONSORED RESEARCH OR DEVELOPMENT

Not applicable

REFERENCE TO A MICROFICHE APPENDIX.

Not applicable

FIELD OF THE INVENTION

The present invention relates to piling and pile driving and more particularly to connectors for splicing timber pile sections so as to prevent lateral movement of adjoining pile sections and to evenly transfer pile load during the pile driving process.

BACKGROUND OF THE INVENTION

Timber piles are often used for transferring load between a building and the underlying earth when soil load bearing pressures are low or unsuitable for building purposes. Because the timber piles are constructed from trees, the length of a particular timber pile is necessarily limited by the height of the tree from which it is constructed. Typically, when timber piles are needed to transfer loads, the length of piling required is far greater than the length of a single timber pile. Therefore, timber piles must be connected or spliced together in order to achieve a desired pile length.

The inventor recently published Statutory Invention Registration H2080 on a timber pile connector. The timber pile connector of SR H2080 has a cylindrical splicing element, a pair of opposing horizontal slots passing through the splicing element, and a penetration limiting member passing through the slots. The first and second ends of the penetration limiting member extend beyond the outer diameter of the splicing element, are bent against the outer surface of the splicing element, and are fixedly welded to the splicing element.

U.S. Pat. No. 3,802,206 (Moore) discloses a splicing means for connecting wooden piles end-to-end to form a long pile for the transfer of pile loads to a lower stronger ground. The splicer of Moore provides a plate-like, substantially horizontal element adapted to lie between adjacent pile ends. Optional epoxy glue between the upper and lower surfaces can be provided between the element and the upper and lower piles. A central upright dowel member extends above and below the plate-like element driven into each pile element respectively.

U.S. Pat. No. 3,201,834 discloses another design for a splicing device. Like the design in the 3,802,206 patent, the splicing device includes a central spike design to penetrate the upper and lower timber pilings. However, the device in U.S. Pat. No. 3,201,834 is designed to fit around the periphery of the two mated timber pilings.

U.S. Pat. No. 4,032,244 discloses a splice element for two wooden utility poles. The splice element is attached to the flatten top of an existing pole. A projecting center shaft extends from the bracket to be received within mating center bores provided in the utility pole, a wooden extension pole or both. Threaded fasteners and metal straps complete the interconnection between the existing pole and the extension pole.

U.S. Pat. No. 4,431,347 (Gillen) discloses a composite timber pile system. A cylindrical splicing element is employed in conjunction with a displaceable leveling material to effectively transfer pile load across uneven pile surfaces. Gillen uses concave indexing dimples to limit the depth of penetration of the splicing element into the upper and lower timber piles. Gillen is incorporated herein by reference.

Timber pile connectors are used in large quantities and remain buried in the timber piling after use, i.e. they are not reused. Because they are relatively large and heavy items, timber pile connectors conventionally have not been mass produced, but instead are manufactured by hand, and often at a location near to the place where the timber pile connectors will be used. Consequently, any increased efficiencies in production of timber pile connectors will lead to significant cost savings.

OBJECTS OF THE INVENTION

It is an object of the invention to provide a splicing element for timber piles that prevents lateral misalignment of the timber piles and effectively transfers load equally and evenly.

It is another object of the invention to provide a splicing element for timber piles suitable for complete prefabrication and requiring a minimal time period for field erection.

It is yet another object of the invention to provide a splicing element for timber piles that is simple, straightforward, easy to use, easy to field erect, and easy to duplicate.

It is still another object of the invention to provide a timber pile connector that is more efficient to construct than prior art timber pile connectors.

These and other objects and advantages of the invention shall become apparent from the following general and preferred description of the invention.

PREFERRED EMBODIMENTS OF THE INVENTION

In the following detailed description of the preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

Figure 4:
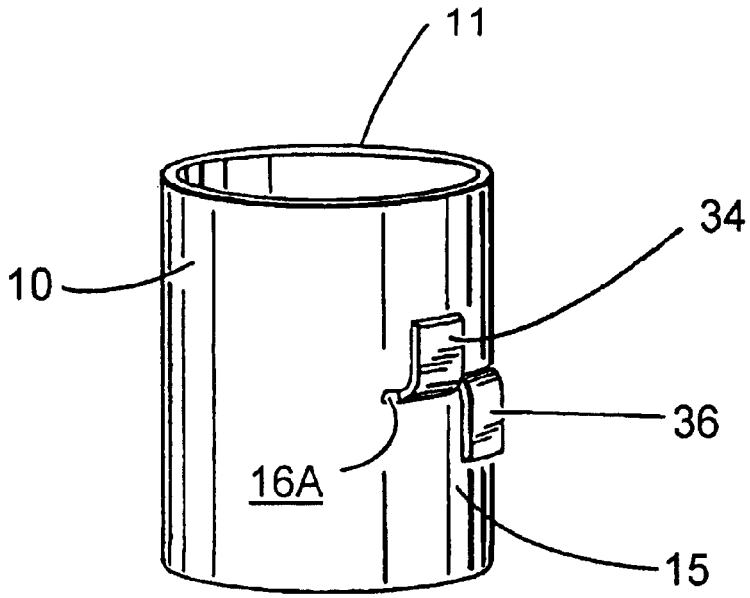
FIG. 4 is a side perspective view of a preferred embodiment of the timber pile connector of the invention.
Figure 5:
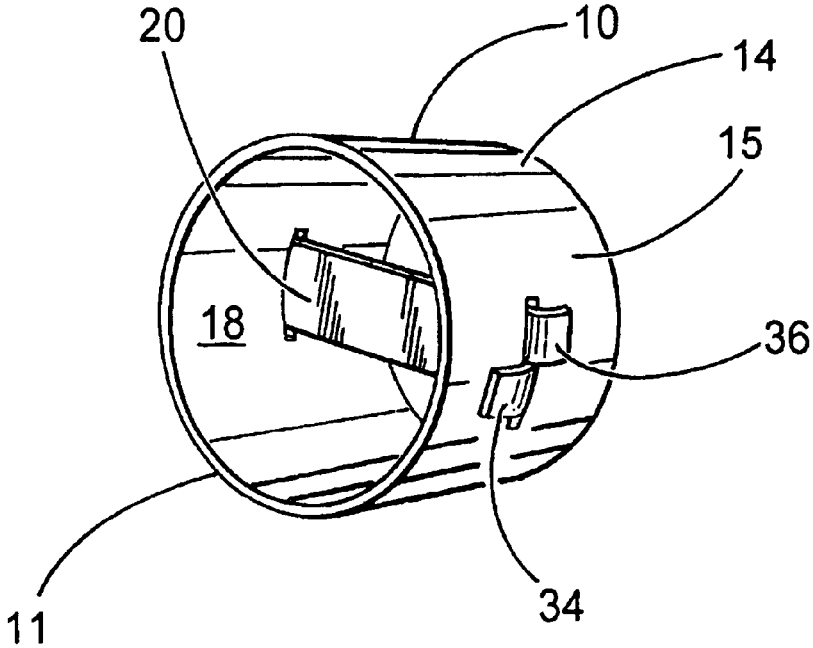
FIG. 5 is a top-side perspective view of a preferred embodiment of the timber pile connector of the invention.

As shown in FIGS. 4 and 5, the invention is a timber pile connector 1 comprising, generally, a section of pipe 10 having a having a bar 20 fixed therein to form a penetration barrier. The bar 20 is fixed to the section of pipe 10 via a plurality of retainer member 34, 36, 44, 46, in a manner described below. The bar 20 acts as a penetration barrier to prevent a timber pile 101, 102 from penetrating beyond the bar 20. The section of pipe 10 has a continuous sidewall 14 and a hollow bore 18. The section of pipe 10 is preferably substantially cylindrical. As indicated in the preferred embodiment shown in FIG. 1, the bar 20 preferably has a substantially flat configuration. All of the components of the invention are preferably made of steel.

Figure 1:
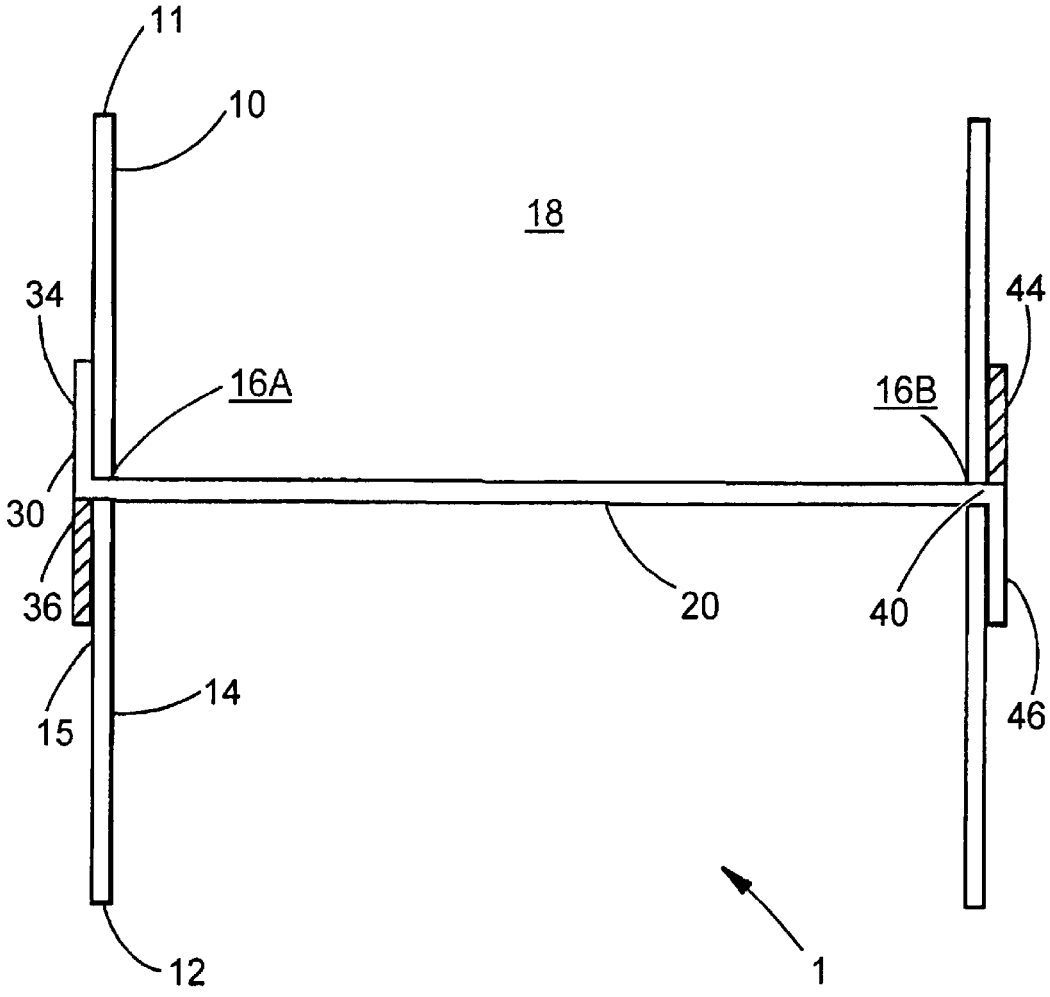
FIG. 1 is a cross-section side view, taken along 1—1 of FIG. 3, of a preferred embodiment of a timber pile connector.
Figure 6:
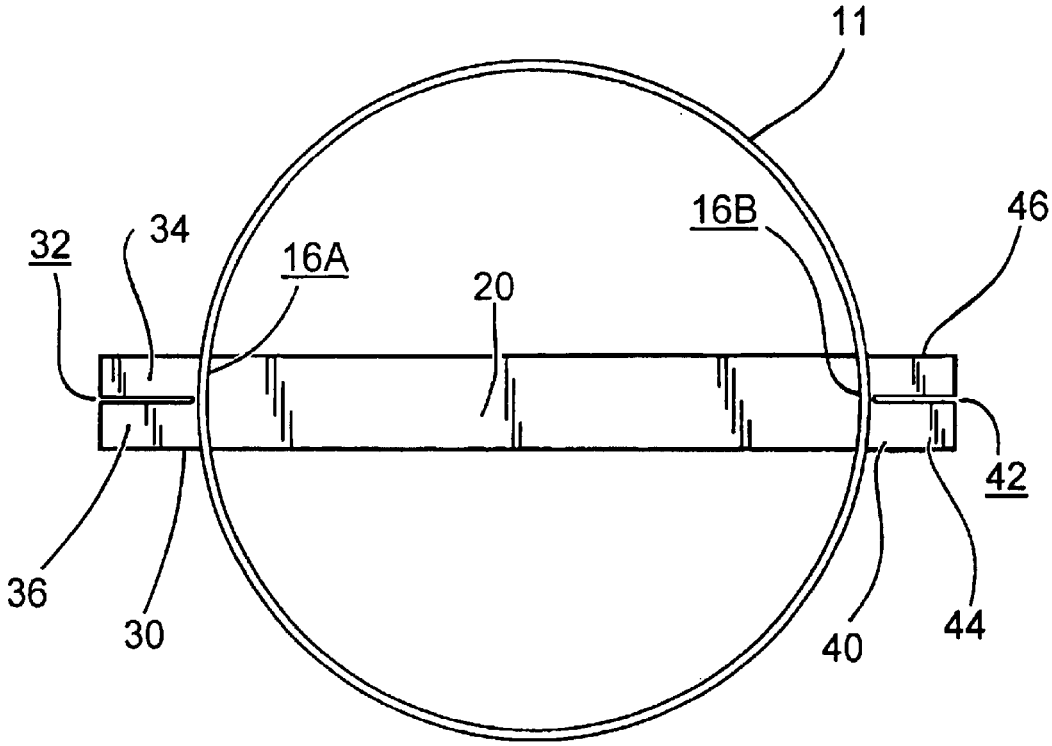
FIG. 6 is a top view of a preferred embodiment of a timber pile connector of the invention, featuring features of the bar prior to bending of the bar into a fixed position relative to the section of pipe.

FIG. 1 provides a cross-section side view taken through the bar 20. For purposes of orientation and reference, the timber pile connector 1 can be considered to have an upper end 11 and a lower end 12, although the ends 11, 12 are preferably symmetrical and interchangeable. As shown in FIG. 1, the section of pipe 10 has a pair of opposing slots 16A, 16B through the sidewall 14. As indicated in FIG. 1, the bar 20 has a lengthwise dimension. As shown most clearly in FIG. 6, a first end 30 of the bar has a first cut 32 therein to thereby form a first upper retaining member 34 and a first lower retaining member 36. A second or opposing end 40 of the bar has a second cut 42 therein to thereby form a second upper retaining member 44 and a second lower retaining member 36. As shown in FIGS. 1 and 6, the bar 20 passes through the opposing slots 16A, 16B. The bar 20 and slots 16A, 16B are preferably sized tightly relative to one another, such that while the bar 20 can be inserted through the slots without difficulty, the bar 20 has little or no room to slide up and down within the slots 16A, 16B.

As shown in FIG. 1, the first and second upper retaining members 34, 44 are bent upward against an outer surface 15 of the side wall 14 of the section of pipe 10, while the first and the second lower retaining members 36, 46 are bent downward against the outer surface 15 of the side wall 14 of the section of pipe. With the retaining members 34, 36, 44, 46 bent against the sidewall 14 in this configuration, the retaining members 34, 36, 44, 46 fixedly secure the bar 20 in the slots 16A, 16B to thereby form a penetration barrier 20 in the section of pipe 10. As discussed in further detail below, the configuration of the retaining members 34, 36, 44, 46 equalizes pressure during pile driving, which helps reduce or eliminate pulling and misalignment of timber piles 101, 102. Although the retaining member 34, 36, 44, 46 may optionally be welded to the outer wall 15 of the section of pipe 10 in the manner of prior art configurations, the configuration of the timber pile connector 1 of the invention makes welding unnecessary.

Figure 3:
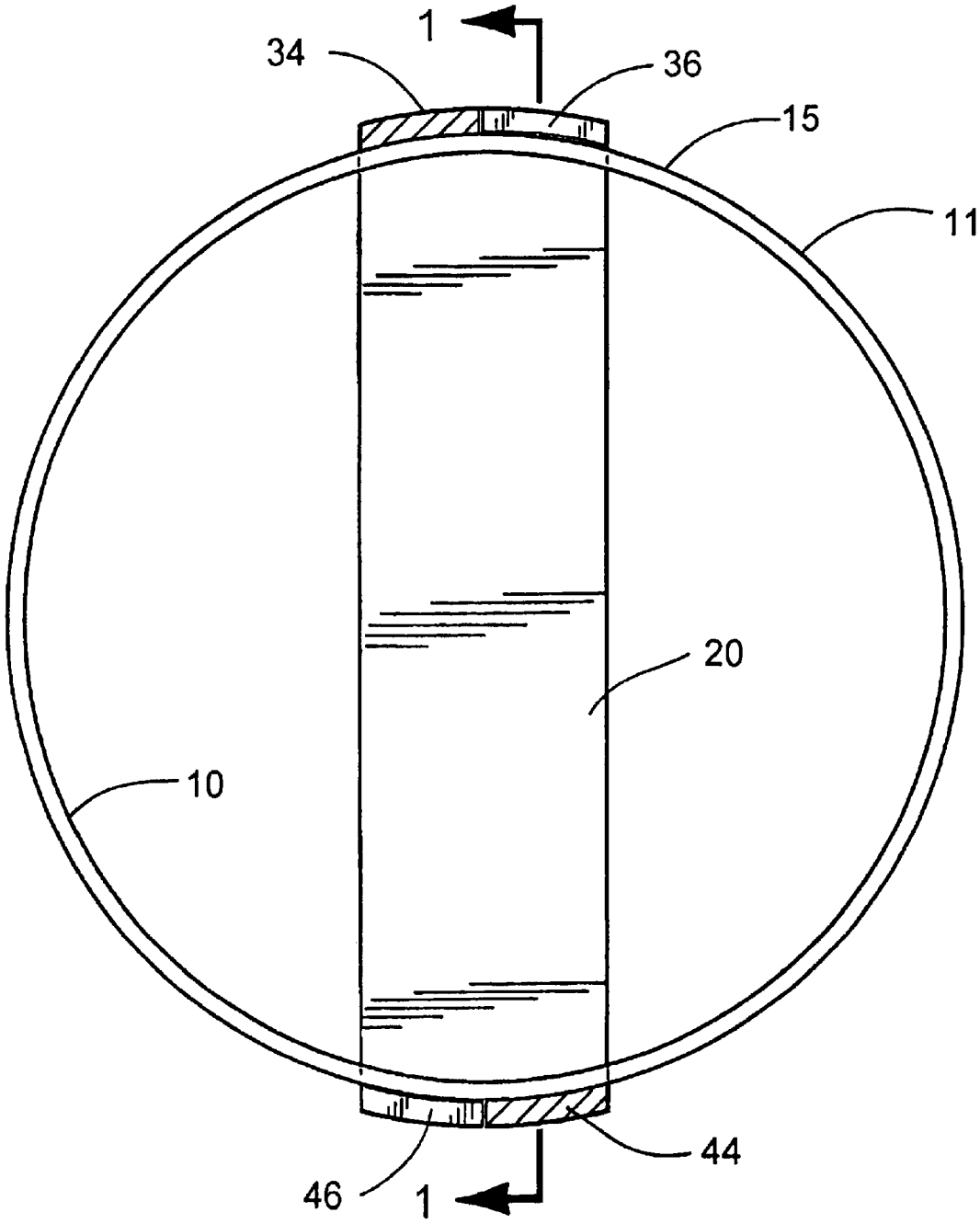
FIG. 3 is a top view of a preferred embodiment of a timber pile connector.

In the preferred embodiment shown in FIG. 3, the first upper retaining member 34 is opposite the second lower retaining member 46, while the second upper retaining member 44 is opposite the first lower retaining member 36.

As indicated in the top view of FIG. 3, in a preferred embodiment the first upper retaining member 34 and the first lower retaining member 36 are of substantially equal width, while the second upper retaining member 44 and the second lower retaining member 46 are of substantially equal width. This configuration maximizes the size and strength of each retaining member.

The horizontal slots 16A, 16B are preferably positioned such that the penetration-limiting member 20 divides the timber pile connector 1 into substantially equal halves. As shown in FIG. 6, the bar 20 has a length greater than the diameter of the sidewall 14 of the section of pipe 10, such that the first and second ends 30, 40 of the bar extend beyond the outer surface 15 of the sidewall 14. The circumference of the upper 11 and lower rims 12 of the timber pile connector 1 may be chamfered to improve the ability of the timber pile connector to penetrate into timber piles.

Figure 2:
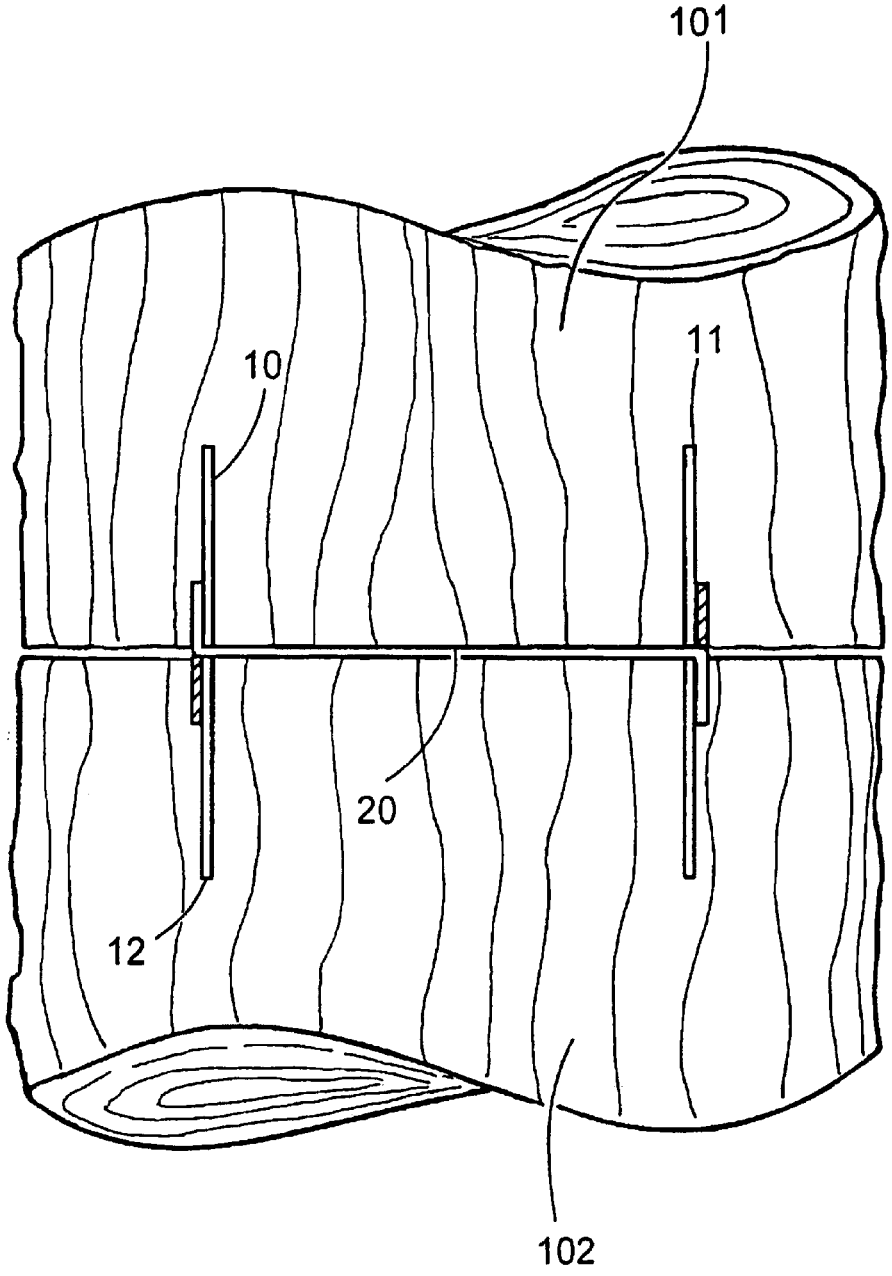
FIG. 2 is a cross-section side view of a preferred embodiment of a timber pile connector of the invention, showing the timber pile connector embedded in lower and upper timber pilings.

In operation, the timber pile connector 1 is used in the manner of conventional timber pile connectors. In FIG. 2, the timber pile connector 1 is shown in cross-section embedded into the upper 101 and lower timber piles 102. Note that the bar 20 is in contact with the lower horizontal face of the upper timber pile 101 and the upper horizontal face of the lower timber pile 102. In this manner, the bar 20 acts as a penetration barrier for preventing the timber pile connector 1 from Penetrating too far into either of the opposing timber piles 101, 102, which would result in pulling and misalignment of the timber piles l0l, 102.

The present invention improves upon the prior art in several ways. The closest prior art is believed to be applicant's own Statutory Invention Registration SIR H2080. In using the timber pile connector of SIR H2080 to drive pilings, the inventor discovered that the H2080 timber pile connector has a tendency to cause pilings to pull relative to one another, and thus to become misaligned. Misalignment can cause significant problems when driving pilings in the field. Because interconnected pilings are subjected to tremendous forces of impact during the pile driving process, misalignment problems become magnified. The H2080 timber pile connector has an upward retaining member on one side and a downward retaining member on the opposite side. This unsymmetrical configuration of the retaining members causes misalignment, because there is a tendency for the timber piles to pull away from retaining members upon contact. Even if both retaining members are oriented in the same direction along the outer wall of the section of pipe, there is a tendency for piles to pull. Pulling and misalignment occur mote frequently when interconnecting pilings of differing hardness. The configuration of the timber pile connector 1 of the present invention appears to eliminate or reduce pulling and misalignment by equalizing the pressure on the opposing pilings 101, 102.

Another benefit of the configuration of the retainer members 34, 36, 44, 46 is that during the pile driving process, the retainer members become wedged against the wood, which adds resistance and assists in preventing the piles 101, 102 from pulling away from the bar 20. In this manner, the uniform wedging of retainer members 34, 36, 44 and 46 in the upper and lower pilings 101, 102 may also contribute to preventing pulling and misalignment.

Some prior art timber pile connectors have employed rounded or narrow retaining bars (e.g. 1 inch by ½ inch). Rounded or narrow bars have a tendency to split the pilings during the pile driving process, which typically causes misalignment. The present invention eliminates this problem by using a bar 20 that has a flattened configuration when viewed from the side. The retainer members 34, 36, 44, 46 are preferably about 1 to 1¼ inch wide. The flat bar 20 is preferably about 2½ inches wide and about ⅛ inch thick. The ends 30, 40 of the bar preferably extend about 1 inch beyond the outer diameter of the sidewall 14.

The present invention is also more efficient to manufacture than prior art timber pile connectors. Prior art timber pile connectors have used welding to secure the retainer member in the timber pile connector. With the configuration of the timber pile connector of the invention 1, welding is unnecessary, which eliminates an entire procedure and step from the manufacturing process.

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

What is claimed is:

1. A timber pile connector comprising:

a section of pipe, said section of pipe having a continuous sidewall and a hollow bore, said section of pipe having a pair of opposing slots through said sidewall, said slots being oriented generally perpendicular to the hollow bore, a bar, said bar having a lengthwise dimension, a first end of said bar having a first cut therein to thereby form a first upper retaining member and a first lower retaining member, a second end of said bar having a second cut therein to thereby form a second upper retaining member and a second lower retaining member, said bar passing through said opposing slots, said first and said second upper retaining members bent upward against an outer surface of said side wall of said section of pipe, and said first and said second lower retaining members bent downward against said outer surface of said sidewall, whereby said retaining members fixedly secure said bar in said slots to thereby form a penetration barrier in said section of pipe.

2. The timber pile connector of claim 1, wherein said first upper retaining member is opposite said second lower retaining member, and said second upper retaining member is opposite said first lower retaining member.

3. The timber pile connector of claim 2, wherein said first upper retaining member and said first lower retaining member are of substantially equal width, and said second upper retaining member and said second lower retaining member are of substantially equal width.

4. The timber pile connector of claim 3, wherein said bar has a substantially flat configuration.

5. The timber pile connector of claim 4, wherein said section of pipe is substantially cylindrical.

6. The timber pile connector of claim 1, wherein said first upper retaining member and said first lower retaining member are of substantially equal width, and said second upper retaining member and said second lower retaining member are of substantially equal width.

7. The timber pile connector of claim 1, wherein said bar has a substantially flat configuration.

8. The timber pile connector of claim 7, wherein said bar is about 2½ inches wide and about ⅛ inch thick.

9. The timber pile connector of claim 1, wherein said section of pipe is substantially cylindrical.

10. A method of manufacturing a timber pile connector for use in splicing timber pilings together in substantially axial alignment, comprising:

providing a section of pipe having a continuous sidewall and a hollow bore, forming a pair of opposing slots through said sidewall of said section of pipe, said slots being oriented generally perpendicular to the hollow bore, providing a bar, said bar having a lengthwise dimension, a first end of said bar having a first cut therein to thereby form a first upper retaining member and a first lower retaining member, a second end of said bar having a second cut therein to thereby form a second upper retaining member and a second lower retaining member, passing said bar through said opposing slots, bending said first and said second upper retaining members upward against an outer surface of said side wall of said section of pipe, and bending said first and said second lower retaining members bent downward against said outer surface of said sidewall, whereby said retaining members fixedly secure said bar in said slots to thereby form a penetration barrier in said section of pipe.

11. The method of claim 10, wherein said first upper retaining member is opposite said second lower retaining member, and said second upper retaining member is opposite said first lower retaining member.

12. The method of claim 10, wherein said first upper retaining member and said first lower retaining member are of substantially equal width, and said second upper retaining member and said second lower retaining member are of substantially equal width.

13. The method of claim 10, wherein said section of pipe is substantially cylindrical.

14. The timber pile connector of claim 13, wherein said bar is about 2½ inches wide and about ⅛ inch thick.

15. The method of claim 10, wherein said section of pipe is substantially cylindrical.

16. The method of claim 10, further comprising welding said retaining members to said outer surface of said section of pipe.

* * * * *

UNITED STATES PATENT AND TRADEMARK OFFICE

CERTIFICATE OF CORRECTION

PATENT NO. : 6,979,151 B1
DATED : December 27, 2005
INVENTOR(S) : Henry Bourgeois It is certified that error appears in the above-identified patent and that said Letters Patent is hereby corrected as shown below:

Title page,
Item [75], Inventor, should read -- Henry Bourgeois, 5505 Ehret Rd. --.

Signed and Sealed this

Twenty-first Day of March, 2006

JON W. DUDAS
*Director of the United States Patent and Trademark Office*